United States Patent [19]

Postonen et al.

[11] Patent Number: 4,654,916

[45] Date of Patent: Apr. 7, 1987

[54] APPARATUS FOR CLEANING HARD SURFACES

[75] Inventors: Arne Postonen, Tungelstavägen 35C, S-137 00 Västerhaninge; Henry Bergström, Partille, both of Sweden

[73] Assignee: Arne Postonen, Sweden

[21] Appl. No.: 705,338

[22] PCT Filed: May 23, 1984

[86] PCT No.: PCT/SE84/00196

§ 371 Date: Jan. 23, 1985

§ 102(e) Date: Jan. 23, 1985

[87] PCT Pub. No.: WO84/04663

PCT Pub. Date: Dec. 6, 1984

[30] Foreign Application Priority Data

May 24, 1983 [SE] Sweden ..... 8302899

[51] Int. Cl.[4] ..... A47L 11/18

[52] U.S. Cl. ..... 15/50 C; 15/1.7

[58] Field of Search ..... 15/49 C, 50 C, 52, 98, 15/320, 384, 1.7

[56] References Cited

U.S. PATENT DOCUMENTS

| | | | |
|---|---|---|---|
| 1,268,963 | 6/1918 | Gray | 15/50 C |
| 1,464,031 | 8/1923 | Daly | 15/50 C |
| 1,694,937 | 12/1928 | Floeter | 15/50 C |
| 1,759,881 | 5/1930 | Bentley | 15/384 |
| 1,949,659 | 3/1934 | Ritter | 15/50 C |

FOREIGN PATENT DOCUMENTS

| | | | |
|---|---|---|---|
| 503630 | 7/1930 | Fed. Rep. of Germany | 15/384 |

*Primary Examiner*—Edward L. Roberts

[57] ABSTRACT

A machine for cleaning of preferably hard surfaces, which machine has two brushes (101,102) rotating against each other. The brushes throw dirt particles through a gap between the brushes to a container (117). Between the brushes and the container there is a transport channel (118) for the dirt particles which widens in an upward direction. Means (128,132) for the supply of liquid detergent are provided having permeable devices (132) which supply liquid detergent to the brushes due to the rotation of the brushes.

3 Claims, 4 Drawing Figures

APPARATUS FOR CLEANING HARD SURFACES

TECHNICAL FIELD

The present invention relates to an apparatus for cleaning of preferably hard surfaces like floors, stairs and such and having two substantially cylindrical brushes rotating against each other, through which the apparatus is supported on the surface, and means for supply of liquid detergent to the brushes.

BACKGROUND

Apparatus for cleaning of carpets, which mostly are specially intended for soft textile carpets, so called fitted carpets, are earlier known. In these apparatuses a detergent in the form of a comparatively dry foam is added. Except for relatively big and expensive machines, which have driving wheels and a driving motor for the propulsion of the machine and which have a suction installation to suck the detergent with dirt particles, no effective and simple device for collecting dirt particles is known. These big machines are not suitable for small areas like cleaning of stairs where the cleaning until now has been made wholly manually.

The object of the invention is to produce an apparatus which can be designed with relatively small dimensions and thus meet a need when cleaning stairs and floors indoors and which by very simple means makes a very effective collection of dirt particles possible.

THE SOLUTION

Said object is achieved by means of an apparatus, wherein the brushes are arranged to transport dirt particles to a least one container merely by means of their rotation between them, wherein at least one transport channel for the dirt particles is positioned between the brushes and the container, said transport channel having one inlet and one outlet located at the container and wherein the transport channel has a scraping edge arranged for each brush and located at the inlet, said scraping edge being intended for removal of adhered dirt particles from the corresponding brush and wherein the device for supply of liquid detergent has permeable devices which are designed to supply liquid detergent to the brushes so that these are moistened.

BRIEF DESCRIPTION OF DRAWINGS

The invention will now be described in two embodiments with reference to the accompanying drawings in which.

BEST MODE OF CARRYING OUT THE INVENTION

Figure 1:
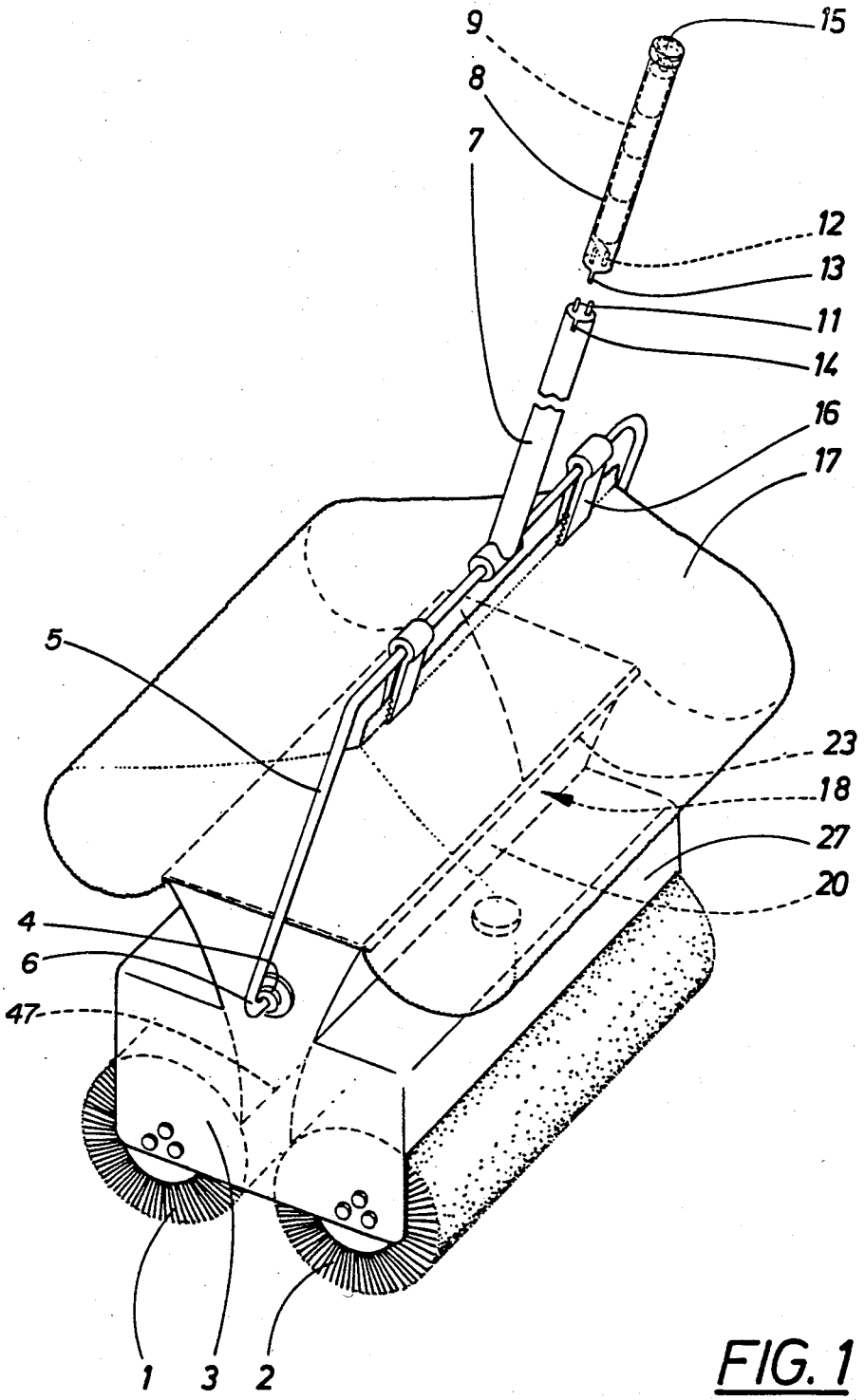
FIG. 1 is a perspective view of the apparatus according to a first embodiment of the invention.

The apparatus according to the invention is a cleaning machine intended for cleaning of preferably hard surfaces like floors, stairs etc. The machine has two brushes 1, 2 which are intended to rotate in opposite directions with respect to each other. The brushes 1, 2 are mounted in bearings in gables 3, which are placed at each end of the brushes. On each gable is a yoke 5 with its ends 6 rotatable mounted at a joint 4 in such a known way that it can easily be dismounted, for example by means of a snap-in device. From the top of the yoke 5 a shaft 7 is erected which is fixed to the yoke. From considerations of space the shaft is shown shortened but has in practice a length which is adjusted to the length of a normal person so that the machine can be handled manually by a person who holds the shaft. The shaft 7 has an upper part 8 which is detachably mounted on the remaining part of the shaft by means of, for example, a bayonet joint or similar device. In this upper part a set of rechargable batteries 9 is located which is intended to be used for supplying two electrical drive motors 10 (see FIG. 3) situated in the machine. As is evident from FIG. 1, the lower part of the shaft has a male connector 11, which is supposed to match a corresponding female connector 12 at the lower end of the upper part 8 of the handle. A guide pin 13 is intended to match a corresponding notch 14 in order to make sure that the correct polarity is achieved. On top of the upper part is an electrical switch 15, for example a push-button switch located by means of which the machine can be started and stopped when the connection between the rechargable batteries and the drive motors is closed and opened respectively.

The yoke 5 also have two clamps 16 designed to hold a container 17 for the machine which is designed to be easily removable and possibly of the throw-away type. The container 17 can be a plastic bag, a moisture-safe paper bag or similar and shall be meant to be fastened in a way which will be described in detail later on. The container 17 has air outlets, not shown, in the form of, for example, perforations for the outlet of the air streaming in to the container by means of the rotation of the brushes 1, 2.

Figure 2:
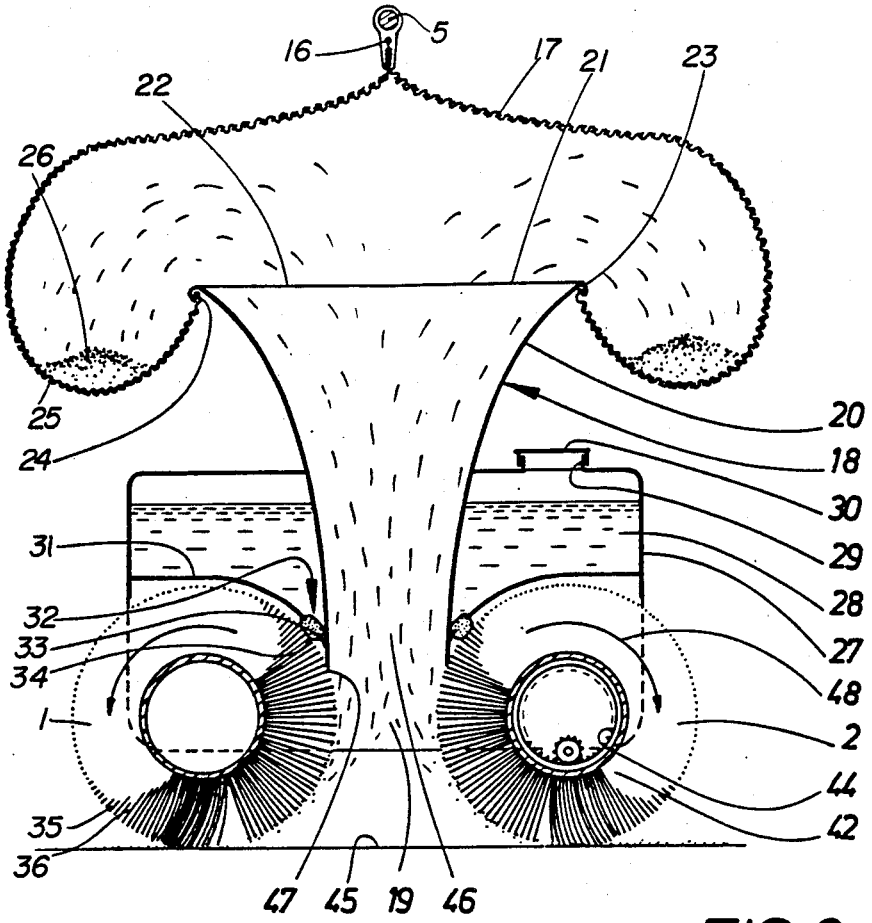
FIG. 2 shows a schematic cross section of the apparatus according to the invention.

As can be seen from FIG. 2 the machine has a transport channel 18 extending from the gap 19 between the two brushes 1, 2 and up to the container 17. The transport channel is of some length and runs on the whole along the total length of the brushes and reaches at its ends the gables 3 and is limited by two walls 20 which are so designed that the transport channel 18 gradually is widened from the brushes and up to the container 17. More exactly the walls 20 have an arched shape so that the transport channel receives a funnel-shaped cross section. The transport channel has at its lower end an inlet 46 which is situated at the gap 19 between the brushes 1, 2 and at its upper end an outlet 21 at the container. At the inlet 46 the walls 20 form scraping edges 47, which bear on the periphery 35 of the brushes 1, 2 in order to scrape away possible dirt particles on the bristles of the brushes. As is evident from FIG. 2, the outlet edge 22 around the outlet 21 is equipped with a groove 23 facing downward, whereby the container 17 has an opening which is intended to correspond to the outlet 21 and a bulge 24, extending around the opening of the container, and intended to snap into the groove 23 and thus be fixed to the groove. In this way, sacklike parts 25 of the container 17 are formed outside of the walls 20, in which parts dirt particles 26 and detergent can be collected. The clamps 16, which are hooked to the container 17, will prevent the container from collapsing.

The machine also has a tank 27 for clean liquid detergent 28, which may be filled through a hole 29, which can be sealed by means of a cover 30. The tank 27 is divided into two parts, situated on each side of the transport channel 18 and has a communication pipe, not shown on the drawings, placed at the bottom of the tank in such a way that the two parts of the tank are communicating vessels thus making it necessary to refill one of the tank parts only. At the bottoms of each tank part are bottom walls 31, which are located above the brushes 1, 2. In each of the bottom walls 31 a permeable device 32 is placed to let the liquid detergent through. The permeable device 32 consists of an opening 33 and at bottle 34 located in the opening. The throttle 34 can, as an example, be made of an elastic rubber material like foam rubber or foam plastic which has a large amount of narrow channels through which the liquid detergent can pass out from the container 27 when the brushes 1, 2 rotate. However these channels are such that the hydrostatic pressure from the liquid can not overcome the throttle resistance in the channels of the throttle when the brushes are stopped thus preventing the liquid detergent to pass. The throttles are so designed that they bear on the periphery 35 of the brushes, that is on the outer end of the bristles 36 of each brush. The contact between the throttles and the brushes is such that the elastic throttle 34 is variably compressed somewhat when the bristles 36 of the brushes 1, 2 pass so that a certain pumping in the throttle occurs which therefore will allow the liquid detergent to pass and to moisten the brushes when the bristles pass. By this, liquid detergent is prevented from floating down to the surface 45 when the brushes are stopped and detergent is only supplied to the brushes 1, 2 when they rotate.

Figure 3:
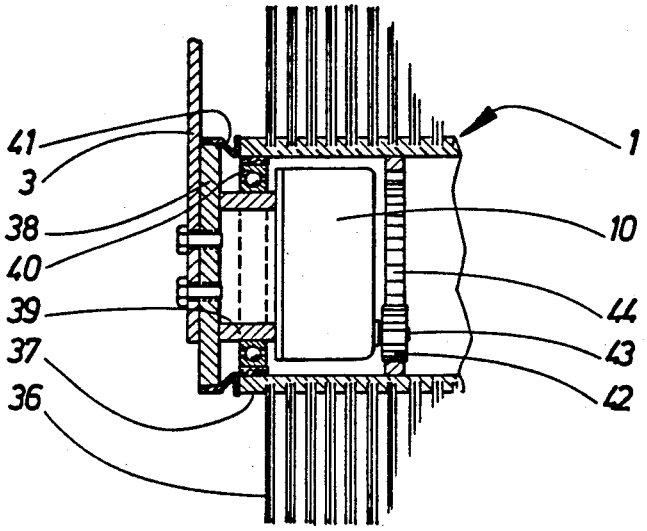
FIG. 3 shows a partly broken longitudinal section of a brush which is part of the apparatus.

FIG. 3 shows more in detail the design, the bearings and the driving of the brushes 1, 2. Each brush has a hub 37 which is tube-shaped and has such a diameter that the drive motor 10 can be placed in the hub. The drive motor 10 for one of the brushes 1 is situated at one end of the brush and fixed to the inner side of one of the gables 3 and the other drive motor is situated at the opposite end of the other brush and fixed to the other gable, whereby a uniform weight distribution is achieved. Each of the gables 3 has on its inner side a mounting plate 38 which is screwed to the gable and has a bearing holder 39 on which is mounted a ball bearing 40 by means of which the brush 1 and its hub 37 are rotatably mounted. A sealing lip 41 seals off the space between the hub 37 and the gable 3 and makes it impossible for moisture and dirt to penetrate into the drive mechanism. The electrical drive motor has a built-in gear, not shown on the drawing, and a gear pinion 42 on its axis 43 which has a mesh with a gear ring 44 with the teeth on its inner surface and which gear ring is placed inside the hub 37. In the opposite end of the hub is a corresponding bearing and sealing arranged. Through not shown, electrical wires the drive motor 10 has electrical connection with the rechargable batteries 9 via the connectors 11 and 12 and the switch 15.

The invention is especially characterized by the fact that the machine according to the invention rests with its brushes 1, 2 against the surface in such a way that their bristles 36 are deformed at the contact with the surface 45 when the brushes rotate, which is indicated in FIG. 2. Furthermore the brushes 1, 2 have relatively long bristles with well matched length and stiffness in order to achieve the intended effect according to the invention.

When cleaning with the machine according to the invention, it is moved by means of the shaft 7 across the surface 45 that shall be cleaned. The surface is reached very close to walls and other obstacles due to the shape of the machine and the machine is therefore especially suitable for cleaning of stairs or cleaning of other limited areas. It is evident that no parts of the machine protrude in front of or behind the brushes but each brush can be the machine be pressed against an upstanding wall of, for example, a stair at the same time as the brushes have a very great range also to the sides because of the very short distance between the gables 3 and the ends of the brushes. When the machine is stopped the brushes 1, 2 do not rotate and, as described above, no liquid detergent 28 flows through the premeable device 32. When the machine is started by means of the electrical switch 15, electrical power is supplied to the drive motors 10, which preferably are DC-motors for, as an example, six or twelve volts whereby their outwardly directed axis 43 is caused to rotate and via the pinion 42 and the gear ring 44 also brings the brushes 1, 2 to rotate. Thus, liquid detergent penetrates the permeable device 32 as has been described earlier and the brushes 1, 2 are moistened by the liquid detergent when the bristles of the brushes pass and the brushes rotate in the direction indicated by the arrows 48. Via the brushes, when the moistened bistles come into contact with the surface 45, liquid detergent is brought to the surface and binds the dirt particles which to some extent also stick to the bristles. At the contact with the surface the bristles are bent backwards in a way that is indicated in FIG. 2, whereby an area contact is achieved instead of a line contact which is more favourable from the cleaning point of view. The bending of the bristles come to an end when they, during the continued rotation, loose their contact with the surface, whereby dirt particles both those which are on the surface within the contact area as well as those that stick to the bristles, are, because of the fast straightening of the bristles, thrown in a tangential direction through the lower inlet 46 of the transport channel 18 either directly through the inlet or after deflections or bounces off the periphery of the opposite brush. The dirt particles, mixed with liquid detergent, continue along the walls 20 up through the transport channel whereby dirt particles from the left brush 1 move substantially along the right wall shown in FIG. 2 and the dirt particles from the right brush will mainly be thrown upwards along the left wall and then pass through the upper outlet and be collected in the sacklike parts 25 of the container 17. By means of the scraping edges 47 it is ensured that dirt particles that may remain on the bristles will be scraped away and fall down to the surface in order to be thrown up through the transport channel 18 next time.

After the cleaning has ended the container 17 may be emptied by removing it from the clamps 16 and by loosening its attachment to the groove 23 along the outlet edge 22. It is also possible that the container is emptied without removal. At such an emptying procedure the sack-like parts 25 are lifted so that the dirt particles can fall down through the transport channel 18 at the same time as the machine is placed with its inlet 46 above a separate receptable for collection of dirt at which the inlet is used as an outlet. It is also possible that a specially designed receptacle of some length may be pushed along the surface in between the brushes. In this case it may be suitable to rotate the brushes in the opposite direction in order to remove dirt particles from the bristles.

Figure 4:
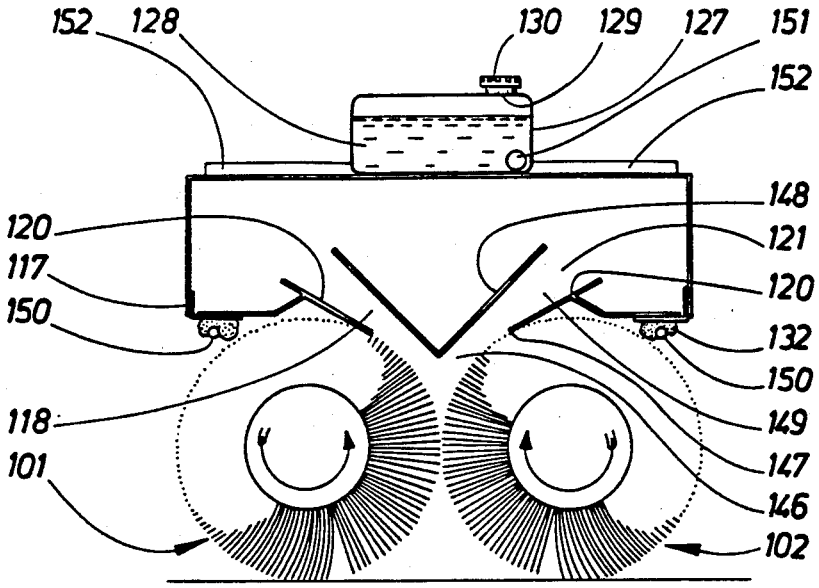
FIG. 4 shows a longitudinal section of a second embodiment of the apparatus.

FIG. 4 shows a second embodiment of the machine according to the present invention. In this version the machine still has the same construction in principal with two counter-rotation brushes 101, 102, a container 117 and a tank 127 for clean liquid detergent, which may be water. As an alternative the water may be mixed with a suitable, liquid detergent. In the version shown the container 117 is divided in two parts separated from each other and realized as a container which can be emptied by removal of an appropriate wall or bottom. In practice the container 117 is assumed to be some kind of throw-away container in the form of a plastic or moisture-safe paper bag or similar. The machine also has two transport channels 118, 149 which are separated from each other by means of two guide plates 148. The two transport channels have each a lower inlet 146, located in the lower part close to the brushes. The two transport channels 118, 149 point at an angle upwards and end in or above the container 117 with their outlets 121.

Below the container 117 is arranged an outlet pipe 150 which, via a not shown liquid line, is in connection with a tank outlet 151 on the tank 128. The outlet pipe 150 has several, not shown, openings, which point upward and are evenly spaced along the full length of the brushes 101, 102. The openings are covered by a combined throttling and distributing device 132 for the liquid, consisting of a material with relatively narrow pores, for example foam plastic, in order to achieve an even distribution of the liquid along the brushes with a small enough amount of liquid. In this way a proper damping of the brushes is achieved so that they and the surface only get damp and not soaked, which should result in an impaired cleaning effect.

As is evident from FIG. 4 the brushes 101, 102 are mounted relatively close to each other so that the brushes on the whole touch each other but they can also be situated at a larger or smaller distance from each other. In a similar way the guide plates 120 with their scraping edges 147 make contact with the brushes so that adhered dirt particles effectively can be scraped away and through their velocity move on along the corresponding transport channel 118. The scraping edges 147 should therefore be in contact with the bristle tops but not extend into the brushes to such extent that they are strongly worn or that the power consumption becomes too high. It has further been verified that the guide plates 120 located nearest to the brushes may very well extend mainly tangentially with the scraping edges situated close to the tangential point, however somewhat displaced against the rotation center of the brushes in order to ensure scraping.

The embodiment shown in FIG. 4 also has air outlets 152 in the form of openings with filters on top of the container 117. The filter is intended to allow the air to pass and to prevent dirt particles from passing. The example shown has one opening on each side of the tank 127 but it is possible to have only one, continuous opening on the upper side of the container. By arranging these air outlets the movement of the dirt particles into the container is considerably facilitated due to the fact that the air stream, generated by the rotation of the brushes 101, 102, is allowed to pass through each transport channel 118, 149 and after that to pass out through the air outlets 152. Due to the air streams the dirt particles are partly borne through the transport channel in such a way that the number of particles falling back is limited. Furthermore the air movements around the brushes are reduced in front of these, which otherwise may move the dirt particles so that they can not be reached by the machine.

The machine according to the invention is designed with the aim to obtain a complete cleaning of hard surfaces not only on open areas but also along walls and on stairs. This has been made possible thanks to the fact that no parts of the machine protrude outside the two brushes 101, 102 but these instead protrude with their periphery forwards as well as backwards so that the brushes reach very close to a wall. To further improve the range of the brushes, tests have been made with various bristle lengths in a way that certain bunches of the bristles have been made longer than most of the other bunches. As an example these bristle bunches may protrude about 12 mm outside the periphery of the brush and these longer bristle bunches may run, as an example, like a spiral around the periphery, whereby these are bent away when they come into contact with the floor surface at the normal contact area of the brush, but are straightened outside of this area, thus reaching floor surfaces and staircase surfaces close to walls and stairs. In this way floor surfaces close to walls and similar things that are parallel to the longitudinal direction of the brushes are reached.

Correspondingly tests have been made with the shape of the ends of the brushes 101, 102 so that a satisfactory range is obtained also side-ways, that is against upwards directed surfaces that are perpendicular to the longitudinal direction of the brushes. This has been achieved because the bristle bunches close to the ends of the brushes have been tilted outwards about 30° from the normal direction of the bristle bunches. Tests have verified that the tilting of the bristle bunches is amplified when sweeping the floor surface, thus avoiding the tilted bristle bunches brushing also up on the wall.

The view according to FIG. 4 is fully schematic. For example, one of the gables is removed for the sake of clearness. Furthermore no shaft with a handle is shown.

The invention is not limited to what is described above or to the embodiments shown on the drawings. For instance, it is not necessary to shape the brushes with special design of the bristle bunches as has been described. It is also possible that the transport channel is not funnel-like but the walls may be in principal parallel. Also the space between the brushes may be considerably smaller so that the brushes are only some centimeters away from each other or even are almost in contact with each other. It is further possible that the brushes are driven by a single, common drive motor in which case the brushes have a drive connection with each other or with the drive motor via a driving belt or the like. It is also possible that the rechargable batteries are located somewhere else, for instance in a compartment above the tank.

What is claimed is:

1. Apparatus for cleaning of preferably hard surfaces such as floors, stairs and the like having two substantially cylindrical brushes rotating in opposition to each other, said apparatus being supported on a surface by said brushes, means for the supply of liquid detergent to the brushes in contact with said brushes to moisten the latter when the brushes are rotated, said means having outlet pipes which run along the longitudinal direction of the brushes and are situated above the periphery of the brushes, said pipes having openings which point upward and which are covered by a combined throttling and distributing device for the liquid, at least one container on said apparatus, said brushes being arranged to transport dirt particles to said container merely by means of their rotation between them, a transport channel for each brush positioned between the brushes and the container, each transport channel having an inlet and an outlet located at the container, a guide plate part of each transport channel extending substantially tangential with respect to the periphery of its corresponding brush, a scraping edge on each guide plate for removal of adhered dirt particles from its corresponding brush, each scraping edge being located at the inlet of its corresponding transport channel and situated substantially at the tangential point to the periphery of its corresponding brush making contact with said periphery, each brush having bristles designed to be bent at contact with the surface and thereafter to straighten out and throw at least part of the dirt particles up through its corresponding transport channel, and an air outlet located in the container in communication with said transport channels at their outlets, whereby an air flow is established passing through each transport channel, said air flow being generated by the rotation of the brushes facilitating the transport of dirt particles through each transport channel.

2. Apparatus according to claim 1, wherein said air outlet comprises at least one outlet opening situated in the upper part of the container and which is provided with a filter.

3. Apparatus according to claim 1, wherein said throttling and distributing device comprises an element of foam plastic or similar material located along each outlet pipe.

* * * * *